United States Patent [19]

Kaim

[11] 4,230,228

[45] Oct. 28, 1980

[54] PIN TYPE SOLID BUTT ROTARY COUPLER

[75] Inventor: John W. Kaim, Chicago, Ill.

[73] Assignee: AMSTED Industries Incorporated, Chicago, Ill.

[21] Appl. No.: 953,922

[22] Filed: Oct. 23, 1978

[51] Int. Cl.[3] ..... B61G 9/00

[52] U.S. Cl. ..... 213/62 A; 213/67 A; 213/69

[58] Field of Search ..... 213/62 R, 62 A, 67 R, 213/67 A, 69, 70, 71, 72; 308/62, 67

[56] References Cited

U.S. PATENT DOCUMENTS

| | | | |
|---|---|---|---|
| 2,990,962 | 7/1961 | Nystrom | 213/62 A |
| 2,990,963 | 7/1961 | Kulieke | 213/62 A |
| 3,157,291 | 11/1964 | Kulieke et al. | 213/62 A |
| 3,610,436 | 10/1971 | Wisler | 213/62 A X |

*Primary Examiner*—Randolph A. Reese

*Attorney, Agent, or Firm*—John L. Schmitt; Fred P. Kostka; Edward J. Brosius

[57] ABSTRACT

A rotary type railroad car coupler is provided with a symmetrical and invertible yoke. A yoke collar, constructed so as to be capable of being reversible, is disposed within a cavity of the yoke. In one preferred embodiment, a pin connecting a shank of the coupler to the yoke collar is positioned so as to be equidistant from both ends of the yoke collar. Thus, as one end of the yoke collar becomes worn, the collar can be reversed. Improved yoke collar service life is obtained.

5 Claims, 10 Drawing Figures

PIN TYPE SOLID BUTT ROTARY COUPLER

BACKGROUND AND SUMMARY OF THE INVENTION

The present invention relates to an improved rotary type railroad car coupler assembly. More particularly, the invention relates to such an assembly having increased service life and effectiveness.

Rotary type railroad car coupler assemblies are conventionally used in associated with railroad cars employed in rotary dump service where the rotating car remains coupled to the immediately adjacent cars. The railroad cars provided for this application are generally equipped with a rotary type coupler at one end and a stationary coupler at the other end. Each rotary coupler must therefore be capable of rotating with respect to the car on which it is mounted. Known rotary couplers are disclosed, for example, in U.S. Pat. Nos. 2,973,104; 2,973,105; 2,990,962 and 2,990,963.

As can be expected, several components within the rotary coupler assembly are subject to wear, and therefore, to periodic replacement. One element which is particularly prone to wear is the yoke collar. The rotary type coupler includes a shank which is attached to the car by being pinned to the yoke collar associated with a draft gear. This yoke collar bears against a yoke during a draft condition thereby transmitting draft forces from the coupler shank to the yoke, striker and car sill, as will be described in detail hereinafter. In any event, the yoke collar is subject to wear which eventually results in excessive slack in coupler operation and requires yoke collar replacement. Improved yoke collar service life and effectiveness are clearly desirable.

Therefore, one object of the present invention is to provide an improved rotary type railroad car coupler assembly.

Another object of the present invention is to provide a rotary type railroad car coupler assembly with a yoke collar having an increased service life.

A still further object of the present invention is to provide a rotary type railroad car coupler assembly having improved ease of maintenance and serviceability, e.g. inspection, lubrication and the like. Other objects and advantages of the present invention will become apparent hereinafter.

An improved rotary type railroad car coupler assembly has now been discovered. The coupler assembly comprises a railroad car sill, a striker secured to the sill, a coupler having a head and a shank, a draft gear and a yoke positioned so as to act in concert with the draft gear and sill to transmit draft and buff forces from the coupler to a body of the railroad car. The yoke is symmetrical and therefore invertible and has a substantially cylindrical cavity portion within which is disposed a yoke collar. This yoke collar, preferably substantially cylindrical in configuration, has two substantially opposing ends and a top and a bottom wall having two substantially opposing apertures therein.

The yoke collar acts to receive at least a portion of the coupler shank and to transmit draft forces from the coupler head to the yoke. Also included is a pin connecting the yoke collar and the shank in such a manner that the yoke collar and shank are substantially free to rotate within the cavity of the yoke. The pin is snugly fitted into both of the apertures in the yoke collar.

The present improvement involves providing a yoke which is symmetrical and therefore invertible and a yoke collar which is constructed so as to be capable of being reversibly disposed within the cavity defined by the yoke. In this manner, when the amount of wear at the end of the yoke collar which bears against the yoke becomes excessive, the coupler can be disassembled and the yoke collar reversed so that the other less worn end of the yoke collar replaces the excessively worn end in frequent contact with the yoke. Likewise, the yoke may be inverted to relocate areas of wear should such occur. The invertible feature of the yoke also simplifies assembly of the coupler since the yoke has no specific top or bottom. The present invention provides for longer, e.g. about twice as long, yoke collar service life as well as reduced manufacturing costs resulting from the yoke and yoke collar having a simpler configuration.

One particularly preferred embodiment of the present invention involves a yoke collar construction in which the center point of each of the substantially opposing apertures is substantially equidistant from each of the substantially opposing ends of the yoke collar. In this embodiment, the yoke collar, pin and shank are originally assembled according to specifications and close tolerances. As the one end of the yoke collar wears from contact with the yoke, the specifications and tolerances no longer apply and excessive slack in the system is observed. At this point, the coupler assembly is disassembled, the yoke collar reversed, and put together again for services. The reversal of the yoke collar results in the system operating at or close to the original specifications and tolerances.

In another preferred embodiment, the present assembly is constructed so that the pin is capable of being inserted in or withdrawn from the substantially opposing apertures of the yoke collar through at least one hole in the sill and/or striker, preferably through holes in both the striker and the sill. This feature provides for simple application or removal of the pin without disturbing the remainder of the system. In addition, the side access hole or holes serve other purposes. For example, system components can be inspected and excessive wear of the pin, shank pin hole and yoke collar detected without removal of other components. Further, these holes provide an effective point or points to lubricate the coupler assembly.

Although the components of the present coupler assembly may have any suitable configuration, preferably the pin and the yoke collar are substantially cylindrical in configuration. In addition, the substantially opposing apertures in each sidewall of the yoke collar are preferably substantially circular in cross section.

These and other aspects and advantages of the present invention are set forth in the following detailed description and claims, particularly when considered in conjunction with the accompanying drawings in which like parts bear like reference numerals.

DESCRIPTION OF THE PREFERRED EMBODIMENT

Figure 1:
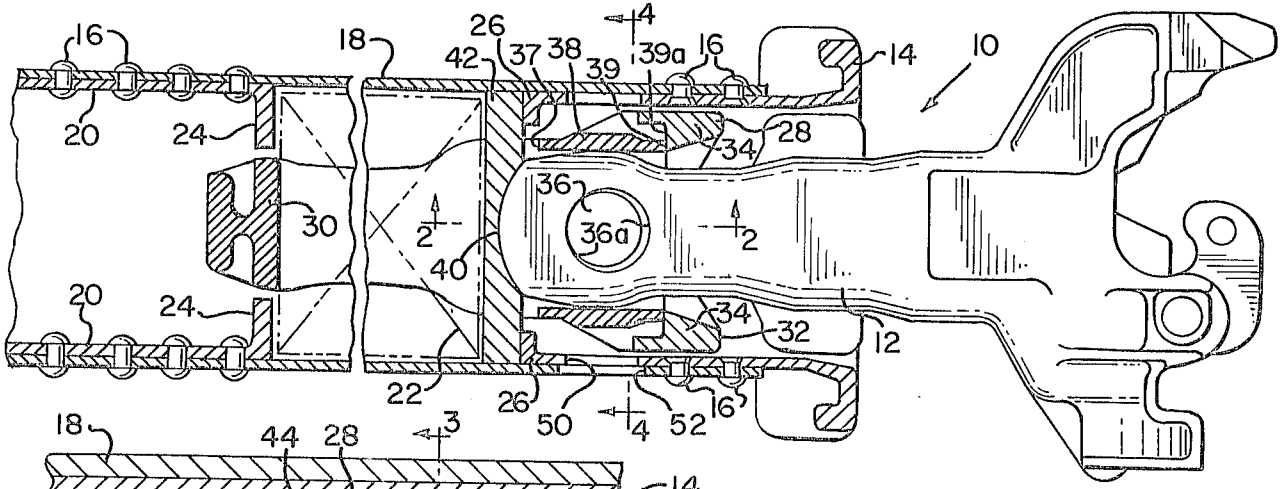
FIG. 1 is a top plan view, partly in section, of a rotary type railroad car coupler embodying the present invention.

Referring now to the drawings, in FIG. 1 there is shown a rotary coupler assembly 10 having a shank 12 which is inserted into the open end of a striker 14 having front stops 26. The striker 14 is attached by any suitable means, such as rivets 16, to a center sill 18. Also suitably attached, as by rivets 16, to the sill 18 are rear lugs 20 providing rear stops 24. A draft gear 22 is diagrammatically represented in phantom lines as being interposed between the stops 24 and a follower 42.

Figure 5:
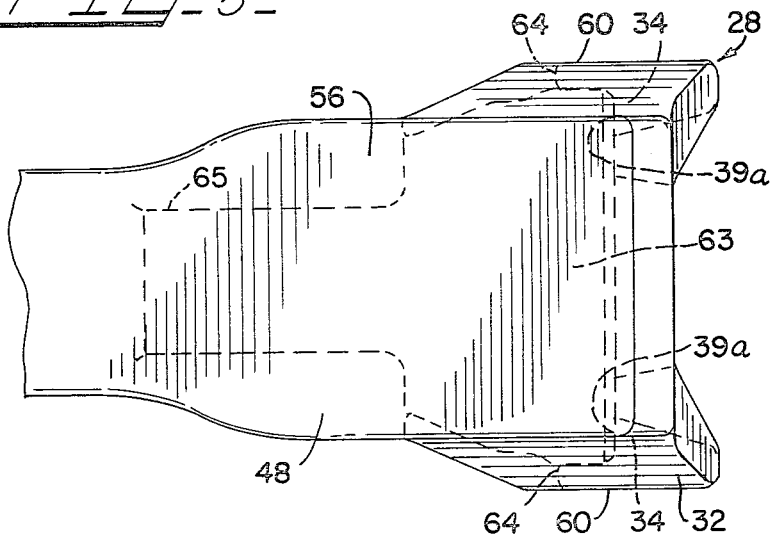
FIG. 5 is a partial plan view of the yoke used in the coupler of FIG. 1.
Figure 6:
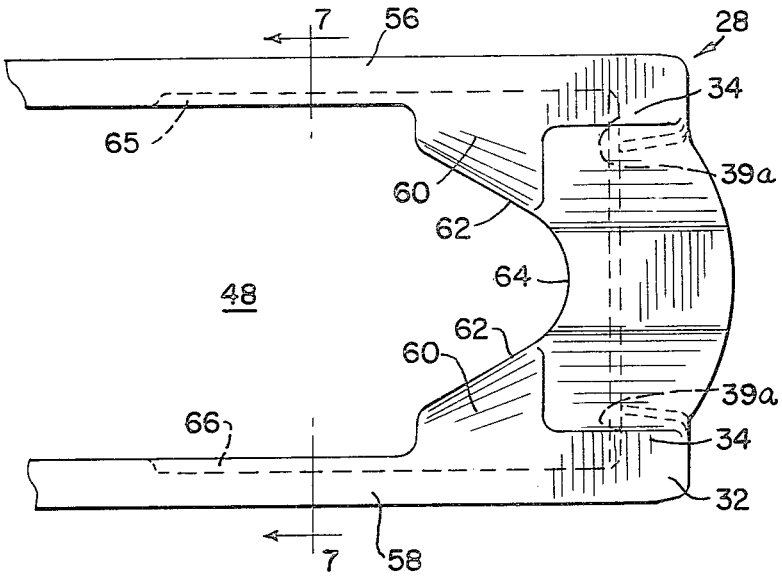
FIG. 6 is an elevational view of the yoke of FIG. 5.
Figure 7:
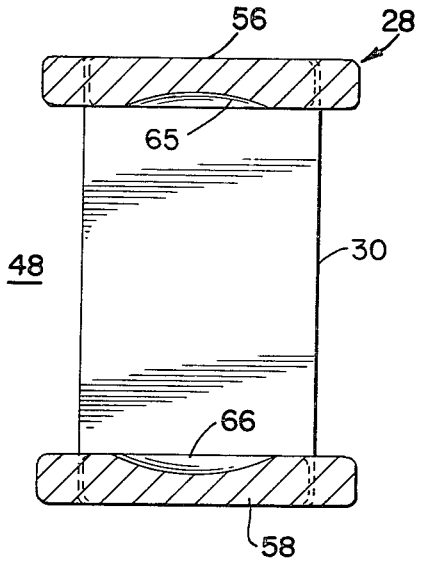
FIG. 7 is a cross-sectional view of the yoke of FIG. 5 as seen generally along the line 7—7 of FIG. 6.

A yoke 28, which is shown in detail in FIGS. 5, 6 and 7, extends from a rear portion 30 behind the draft gear 22 to a front portion 32 having a radially inwardly extending flange 34. The shank 12 of the coupler 10 is connected by a pin 36 inserted through an aperture 36*a* in the shank 12 to a yoke collar 38 which has a trailing edge 37 and a leading edge 39. The yoke collar 38 is shown in detail in FIGS. 8, 9 and 10. The leading edge 39 of the yoke collar 38 is arranged to abut a rear edge 39*a* of the flange 34 of the yoke 28.

Figure 2:
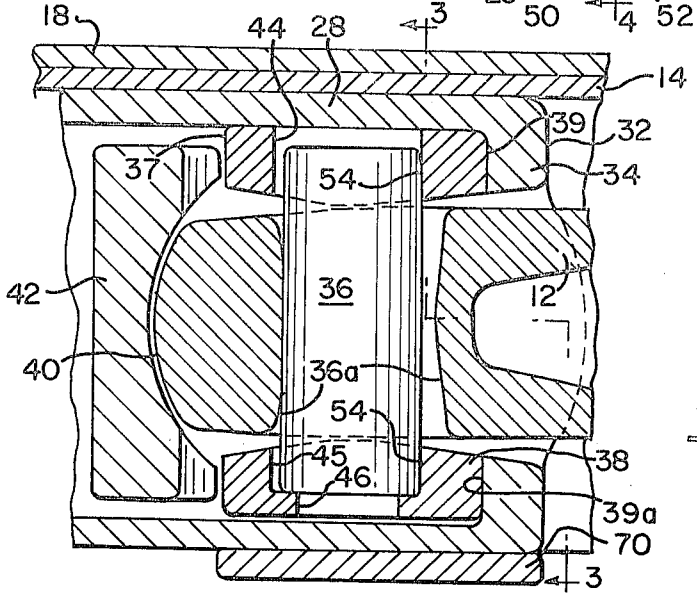
FIG. 2 is an enlarged cross-sectional view taken along the line 2—2 of FIG. 1.
Figure 10:
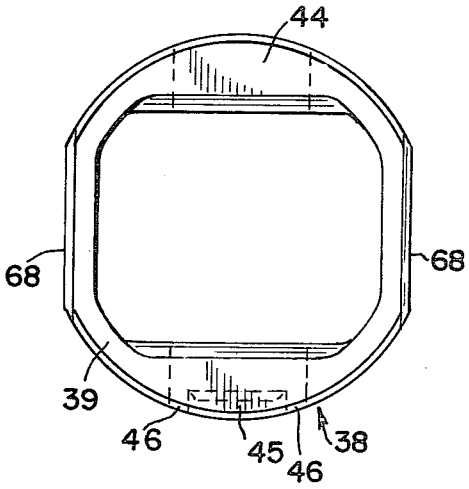
FIG. 10 is a front elevational view of the yoke collar of FIG. 8.

As best shown in FIGS. 2 and 10, the yoke collar 38 has a first opening 44 therein for receiving the pin 36. The first opening 44 is open so that pin 36 can be inserted. However, a second opening 45 in the yoke collar 38 is restricted by a pin seat flange 46. The assembly of FIG. 2 is shown in its normal operating position with the pin 36 being vertically disposed and held in its proper position by the pin seat flange 46 located beneath the pin 36.

In a draft condition of the coupler 10, the shank 12, acting through the pin 36, urges the yoke collar 38 forward (to the right in FIG. 1). The leading edge 39 of the yoke collar 38 abuts the rear edge 39*a* of the yoke flange 34 and moves the yoke 28 forward. The rear portion 30 of the yoke 28 contacts the rear end of the draft gear 22 thereby urging the front end of the draft gear 22 into contact with a follower 42 located behind the stops 26. The striker 14 and the sill 18 transmit the draft forces directly to a body of the railroad car.

In a buff condition of the coupler 10, a butt end 40 of the shank 12 pushes the follower 42 into contact with the front end of the draft gear 22. The rear end of the draft gear 22 bears against the rear stops 24 thereby permitting the rear lugs 20 to transmit the buff load to the sill 18.

The yoke collar 38 is constructed so that when the yoke collar 38 is in a nonworn condition, a center line of the first opening 44 and the second opening 45 is substantially equidistant from both the trailing edge 37 and the leading edge 39 of the yoke collar 38. In other words, the first opening 44 and the second opening 45 are equidistant between the trailing edge 37 and the leading edge 39 of the yoke collar 38. Because the yoke collar 38 is also symmetrical, this feature allows the yoke collar 38 to be reversed so that the trailing edge 37 is positioned to abut the rear edge 39*a* of the flange 34 of the yoke 28.

After a period of use, the leading edge 39 and a front surface 54 of the first and second collar openings 44, 45 become worn. The wear of the leading edge 39 occurs during rotation of the coupler shank 12 during, for example, a rotary dump procedure, when the leasing edge 39 slides against the rear edge 39*a* of the collar flange 28. Wear of the front surface 54 of the yoke collar openings 44, 45 occurs when the pin 36 bears against the opening 44, 45 in a draft condition.

When this noted wear becomes sufficient, the yoke collar 38 may be removed from the coupler 10 and reversed so that the trailing edge 37 now abuts against the rear edge 39*a* of the yoke flange 34. Such reversal of the yoke collar 38 permits the coupler assembly 10 to again be operated according to specifications, e.g. within slack tolerances. In addition, reversal of the yoke collar 38 provides for about twice as much wear and service life before this component must be replaced. Note that the yoke 28 is also symmetrical which allows the yoke 28 to be inverted thereby allowing areas of wear to be relocated.

Figure 3:
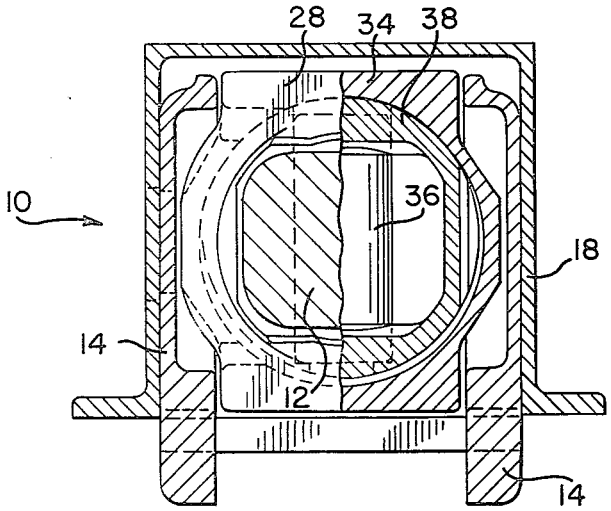
FIG. 3 is a cross-sectional view taken along the line 3—3 of FIG. 2.
Figure 4:
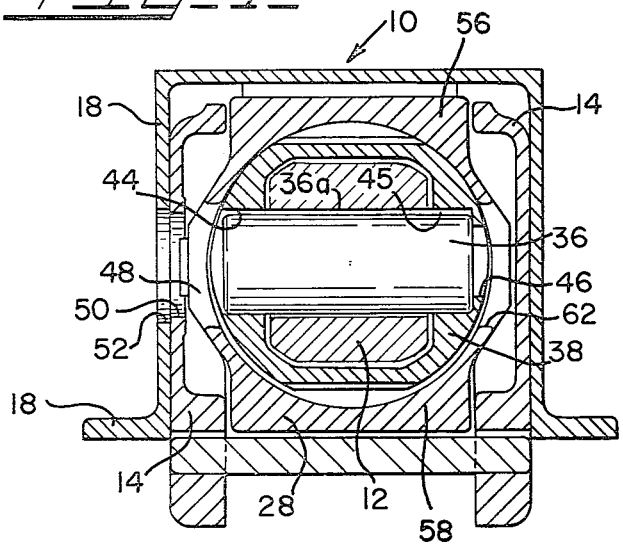
FIG. 4 is a cross-sectional view of the embodiment shown in FIGS. 1, 2 and 3 with the connecting pin in position for removal from the coupler assembly, as generally taken along the line 4—4 of FIG. 1.

Assembly and disassembly of the coupler 10 may be best understood with reference to FIGS. 3 and 4 and involves side access to the pin 36.

Referring specifically to FIG. 4, the shank 12 of the coupler 10, the yoke collar 38 and the pin 36 are rotated 90° from the position shown in FIG. 3. In this rotated position, the pin 36 is horizontally positioned and in substantial alignment with a side space 48 formed between a top portion 56 and a bottom portion 58 of the yoke 28, a cylindrical aperture 50 of the striker 14, and a cylindrical aperture 52 of the sill 18. The top portion 56 and the bottom portion 58 of the yoke 28 are joined by sidewalls 60 defined in part by converging inner edges 62. The edges 62 in turn join to form a radiused portion 64. This radiused portion 64 lies to a front of the openings 44, 45 in the yoke collar 38 thus allowing removal of the pin 36. The top and bottom portions 56, 58 and sidewalls 60 form a cylindrical-shaped cavity 63 in which the yoke collar 38 may be rotationally disposed. The sizes of apertures 50 and 52 are such that the cylindrical pin 36 can be inserted in or withdrawn from the holes 44 and 45 of the yoke collar 38.

With the pin 36 withdrawn, wear on the various components of the coupler assembly 10 may be monitored and inspected. Dry lubricant may be added to the assembly to aid in performance if required. Once such task or tasks have been performed, the pin 36 is inserted through apertures 50 and 52, yoke space 48 and yoke collar openings 44, 45. The shank 12, the yoke collar 38 and the pin 36 are then rotated to the position shown in FIG. 3 in which the coupler assembly 10 is ready for normal operation.

If the inspection noted above discloses that the wear surfaces, for example the leading edge 39 of the yoke collar 38, have become excessively worn, reversal of the yoke collar 38 may be accomplished as follows. First, the shank 12 and coupler head may be withdrawn from the yoke 28. Next, yoke support plates 70 which are affixed at spaced intervals across a bottom of the sill 18 are detached allowing the yoke 28, draft gear 22, follower 42 and yoke collar 38 to be removed.

The draft gear 22 in the yoke 28 is then compressed allowing the follower 42 to be withdrawn from the yoke 28 through the side space 48. The yoke collar 38 then may be slid toward the rear portion 30 of the yoke 28 in a top and a bottom radiused channel 65, 66 formed as part of the top and bottom portions 56, 58 respectively.

Figure 8:
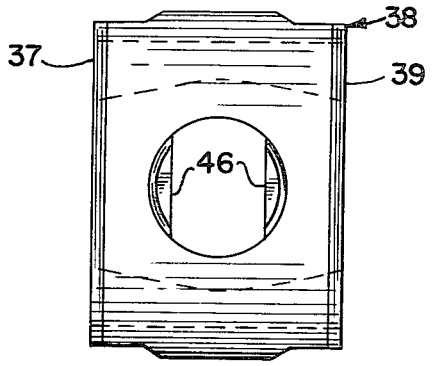
FIG. 8 is a plan view of the yoke collar used in the coupler of FIG. 1.
Figure 9:
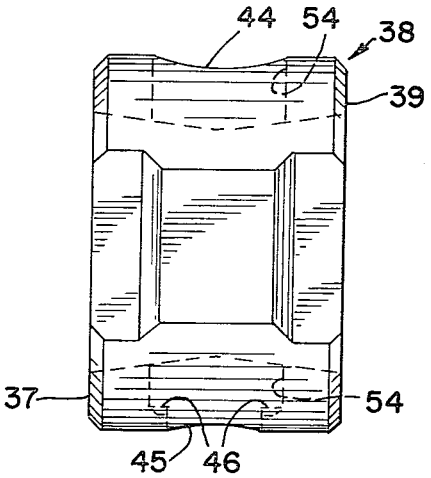
FIG. 9 is an elevational view of the yoke collar of FIG. 8.

As is best seen in FIGS. 8, 9 and 10, the yoke collar 38 has a substantially circular cross-sectional configuration modified by flattened sidewalls 68. Since the yoke collar 38 has been rotated 90 degrees, the sidewalls 68 are positioned parallel and adjacent to the top and bottom yoke portions 56, 58 which allow the yoke collar 38 to be moved through the yoke space 48.

The yoke collar 38 may then be reversed and reinserted through the space 48 in the yoke 28. Note also that the yoke 28 may also be inverted if such is desirable. Reassembly of the coupler may be completed by reversing the steps noted for disassembly.

While various modifications may be suggested by those versed in the art, it should be understood that I wish to embody within the scope of the patent warranted hereon, all such modifications as reasonably and properly come within the scope of my contribution to the art.

What is claimed is:

1. In a rotary type railroad car coupler assembly including a sill, a striker secured to said sill, a coupler having a head and a shank, a draft gear, a yoke positioned so as to act in concert with said draft gear and said striker to transmit draft forces from said coupler to said sill, said yoke having a substantially cylindrical cavity therein, a yoke collar disposed in said cavity, said yoke collar having two substantially opposing ends and two substantially opposing pin apertures therein, said yoke collar acting to receive at least a portion of said shank end to transmit draft forces from said coupler head to said yoke, and a pin connecting said yoke collar and said shank whereby said yoke collar and said shank are free to rotate within said yoke cavity, said pin being fitted into both of said pin apertures in said yoke collar, the improvement which comprises a yoke collar constructed so that said collar is capable of being reversibly disposed within said yoke cavity, and said yoke invertibly disposed within said striker and said sill.

2. The assembly of claim 1 wherein the center point of each of said substantially opposing pin apertures is equidistant from each of the substantially opposing ends of said yoke collar.

3. The assembly of claim 1 wherein said pin is capable of being inserted in or withdrawn from said substantially opposing pin apertures through at least one side access hole in said sill and/or said striker.

4. The assembly of claim 1 wherein said pin and said yoke collar have substantially cylindrical configurations.

5. The assembly of claim 1 wherein said yoke has a symmetrical configuration formed by a top and a bottom portion, said portions having an inner radiused channel formed therein to receive said yoke collar in a sliding relationship.

* * * * *